US006378477B1

(12) United States Patent
Fukuhara et al.

(10) Patent No.: US 6,378,477 B1
(45) Date of Patent: Apr. 30, 2002

(54) VALVE TIMING CONTROL DEVICE

(75) Inventors: Katsuyuki Fukuhara, Hyogo; Hiroyuki Kinugawa, Tokyo, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/888,405

(22) Filed: Jun. 26, 2001

(30) Foreign Application Priority Data

Dec. 25, 2000 (JP) ..... 2000-393407

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,943,989 A * 8/1999 Kira ..... 123/90.17
6,105,543 A * 8/2000 Ogawa ..... 123/90.17
6,318,319 B1 * 11/2001 Miyasaka et al. ..... 123/90.17
6,330,870 B1 * 12/2001 Inoue et al. ..... 123/90.17

FOREIGN PATENT DOCUMENTS

| | | |
|---|---|---|
| JP | 10-159519 | 6/1998 |
| JP | 10-159520 | 6/1998 |

* cited by examiner

*Primary Examiner*—Weilun Lo
(74) *Attorney, Agent, or Firm*—Sughrue Mion, PLLC

(57) ABSTRACT

A valve timing control device has a lock pin for controlling the rotation between first and second rotors. A purge valve is arranged at the lock pin, the purge valve discharging air-mixing oil into a discharge hole in a release operation. On application of first pressure of release hydraulic pressure, a part of the first pressure is discharged through the purge valve, a backward pressure chamber and the discharge hole to the outside the device. Therefore, the lock pin is slid to reduce applied pressure, and it can delay a release operation to prevent the occurrence of beat noise on starting an engine.

11 Claims, 11 Drawing Sheets

ON APPLICATION OF RETARDATION OIL HYDRAULIC PRESSURE RELEASE OIL PRESSURE CHARACTERISTICS

ON APPLICATION OF ADVANCE OIL HYDRAULIC PRESSURE

ON APPLICATION OF RETARDATION OIL HYDRAULIC PRESSURE

ON APPLICATION OF ADVANCE OIL HYDRAULIC PRESSURE

ON APPLICATION OF RETARDATION OIL HYDRAULIC PRESSURE

ON APPLICATION OF RETARDATION OIL HYDRAULIC PRESSURE RELEASE OIL PRESSURE CHARACTERISTICS

ON APPLICATION OF ADVANCE OIL HYDRAULIC PRESSURE RELEASE OIL PRESSURE CHARACTERISTICS

ON APPLICATION OF ADVANCE OIL HYDRAULIC PRESSURE

ON APPLICATION OF RETARDATION OIL HYDRAULIC PRESSURE

ON APPLICATION OF ADVANCE OIL HYDRAULIC PRESSURE

ON APPLICATION OF RETARDATION OIL HYDRAULIC PRESSURE

VALVE TIMING CONTROL DEVICE

BACKGROUND OF THE INVENTION

1. Field of the Invention

The present invention relates to a valve timing control device for modifying the. opening and closing timing of the intake and exhaust valves in an internal-combustion engine (hereafter, referred as an engine) according to any operating condition.

2. Description of the Prior Art

Conventional valve timing control devices having various kinds of construction are provided as disclosed in JP-A-1998/159519 and JP-A-1998/159520, for example.

FIG. 1 is a lateral cross-sectional view of an internal construction of a conventional vane-type valve timing control device. FIG. 2 is a longitudinal cross sectional view taken along lines A—A of FIG.1. FIG. 3A is an enlarged longitudinal cross sectional view of a release valve in the conventional valve timing control device shown in FIG. 1 and FIG. 2. FIG. 3B is an enlarged lateral cross sectional view of the state of the release valve on application of advance hydraulic pressure. FIG. 3C. is an enlarged lateral cross sectional view of the state of the release valve on application of retardation hydraulic pressure. In the drawings, reference numeral 1 denotes a pulley connected to a crankshaft (not shown) of the engine to rotate in conjunction with the crankshaft (not shown) through chains (not shown). 2 denotes a housing fixedly provided with the pulley 1 and having a bearing 2*a* used between the housing 2 and an intake camshaft or an exhaust camshaft (hereafter, referred as a camshaft). 4 denotes a case having a plurality of shoes 4*a* projected from an inner peripheral portion of the case 1 to constitute a plurality of hydraulic pressure chambers between the shoes 4*a*. 5 denotes a cover for closing the hydraulic pressure chambers of the case 4. The housing 2, the case 4 and the cover 5 are integrated by a threaded member 6 such as bolts and so on. Here, the pulley 1, the housing 2, the case 4 and the cover 5 constitute a first rotor.

A rotor (second rotor) 9 is integrally locked on one end 3*a* of the camshaft 3 through a washer 7 by a threaded member 8 such as bolts and so, on. The rotor 9 is rotatably arranged within the first rotor. A plurality of vanes 9*a* is arranged an outer peripheral portion of the rotor 9 to divide the plurality of hydraulic pressure chambers into advance side hydraulic pressure chambers 10 and retardation side hydraulic pressure chambers 11. A first oil path 12 and a second oil path 13 are arranged within the camshaft 3. The first oil path 12 performs supplies of hydraulic pressure to and. discharges thereof from the advance side hydraulic pressure chamber 10. The second oil path 13 supplies hydraulic pressure to and discharges hydraulic pressure from the retardation.side hydraulic pressure chamber 11. Further, seal members i4 are arranged on both front ends of the shoes 4*a* of the case 4 and the vanes 9*a* of the rotor 9, respectively. The each seal member 14 includes a seal 14*a* and a plate spring 14*b* to prevent leakage of oil between the both hydraulic pressure chambers 10 and 11.

A lock pin 15 having a substantially cylindrical shape is arranged on the housing 2 constituting the first rotor, and controls the relative rotation of the first and second rotors to prevent the following occurrence of beat noise (abnormal noise). Since a hydraulic pressure within the valve timing control device is reduced on starting the engine, the rotor 9 vibrates in the rotational direction as a result of a cam load applied to a cam (not shown) integrated with the camshaft 3 and thus the first and second rotors undergo repetitive contact and separation as a result of the vibration. Therefore, the lock pin. 15 can engage in an engagement hole as will be explained hereafter due to being biased by a biasing member 17 such as coil spring and so on, the biasing member 17 being arranged between a rear wall within a backward pressure chamber 16 and the lock pin 15. The lock pin 15 includes a small radius part 15*a* inserted in the engagement hole, a large radius part 15*b* having an outer diameter substantial equal to an inner diameter of the backward pressure chamber 16, and a hole 15*c* having a bottom therein. The hole 15*c* is formed in the large radius part 15*b* and supports one end of the biasing member 17. A discharge hole 18 is formed in the backward pressure chamber 16, the discharge hole 18 of discharging a backward pressure of the lock pin 15. On the other hand, the engagement hole 19 for allowing insertion of the lock pin 15.is formed in the vane 9*a* of the rotor 9 acting as the second rotor. The engagement hole 19 communicates with a release valve 21 through an oil hydraulic supply path 20 of supplying hydraulic pressure to release the lock pin 15. As shown in FIG. 3A, FIG. 3B and FIG. 3C, the release valve 21 includes a valve chamber 21*a* having an oval shape, a slide plate 21*b* having a circular shape in cross section, and a perforation hole 21*c* having an oval shape in cross section. The slide plate 21*b* is movable in a long radius direction in the valve chamber 21*a*. The perforation hole 21*c* is formed at a bottom of the valve chamber 21*a*, and communicates with the oil hydraulic supply path 20. As shown in FIG. 1, FIG. 3A, FIG. 3B and FIG. 3C, an advance side pressure partition path 22 communicates with the advance side hydraulic pressure chamber 10 and a retardation side pressure partition path 23 communicates with the retardation side hydraulic pressure chamber 11. These paths 22 and 23 are connected to the valve chamber 21*a* of the release valve 21. With the release valve 21, when the pressure of the advance side hydraulic pressure chamber 10 is higher than that of the retardation side hydraulic pressure chamber 11, as shown in FIG. 3B, the slide plate 21*b* moves toward the retardation side in the valve chamber 21*a*. Thus, the slide plate 21*b* closes the retardation side pressure partition path 23, and communicates the advance side pressure partition path 22 to the oil hydraulic supply path 20 through the perforation hole 21*c* to supply the hydraulic pressure of the advance side hydraulic pressure chamber 10 thereto. On the other hand, when pressure of the retardation side hydraulic pressure chamber 11 is higher than that of the advance side hydraulic pressure chamber 10, as shown in FIG. 3A and FIG. 3C, the slide plate 21*b* moves toward. the advance side in the valve chamber 21*a*. Thus, the slide plate 21*b* closes the advance side pressure partition path 22, and communicates the retardation side pressure partition path 23 to the oil hydraulic supply path 20 through the perforation hole 21*c* to supply the hydraulic pressure of the retardation side hydraulic pressure chamber 11 thereto.

Next, a release operation will be described.

When the lock is released, hydraulic pressure from an oil pump (not shown) is supplied to the engagement hole 19 through the advance side hydraulic pressure chamber 10 or the retardation side hydraulic pressure chamber 11, the release valve 21 and the oil hydraulic supply path 20. Thus, the lock pin 15 is moved backward in the backward pressure chamber 16 against the biasing force of the biasing member 17. Here, the backward pressure of the lock pin 15 is discharged through the discharge hole 18 to the outside of the valve timing control device. With the discharge of the backward pressure, the area subjected to hydraulic pressure is constant from the locked state to the released state. When the small radius part 15*a* of the lock pin 15 is disconnected from the engagement hole 19 to be held in the backward pressure chamber 16, the lock pin 15 is released to allow free rotation between the first and second rotors.

Incidentally, when the engine is stopped, oil in the advance side hydraulic pressure chamber 10 and the retardation side hydraulic pressure chamber 11 moves downwardly to an oil-pan (not shown) through the first and second oil path 12 and 13 and so on. Therefore, air builds up in pipe arrangement such as the respective hydraulic pressure chambers and the respective oil paths. When the engine is restarted in this state, the hydraulic pressure is increased due to the oil pump (not shown) and air accumulated in the pipe arrangement is simultaneously discharged at once. Thus, the air-mixing oil is applied in the valve timing control device to release instantly the lock pin 15 from the engagement hole 19.

However, the following problems result from the above structure for a conventional valve timing control device.

When the air-mixing oil releases the lock on starting the engine, the hydraulic pressure in the advance side hydraulic pressure chamber 10 and the retardation side hydraulic pressure chamber 11 cannot absorb the cam load described above. Since the first and second rotors repeat contact and separation there-between, it cannot prevent the occurrence of beat noise (abnormal noise).

SUMMARY OF THE INVENTION

Accordingly, it is an object of the present invention to provide a valve timing control device, which prevents the occurrence of beat noise (abnormal noise) in release operation occurred by the air-mixing oil on starting the engine.

In order to achieve the object of the present invention, a valve timing control device comprises a first rotor rotating in synchronization with a crankshaft of an internal-combustion engine; a second rotor fixed on an end of an intake camshaft or an exhaust camshaft of the internal-combustion engine and rotatably arranged in the first rotor; a lock member locking the first and second rotors at a required angle which the second rotor forms with the first rotor; a backward pressure chamber arranged at any one of the first and second rotors, accommodating the lock member and a biasing member biasing the lock member, and having a discharge hole of discharging backward pressure of the lock member; and an engagement hole arranged in the other, allowing insertion of the lock member, and having an oil hydraulic supply path supplying hydraulic pressure to release the lock member, wherein releasing hydraulic pressure characteristics is provided with a hysteresis characterized in that releasing hydraulic pressure is larger than holding-releasing hydraulic pressure. Thus, when hydraulic pressure rises on starting the engine, the lock member is not quickly released, and is released after applying hydraulic pressure which controls the valve timing control device. Therefore, it can prevent the occurrence of beat noise (abnormal noise).

The valve timing control device may comprise a purge valve mechanism arranged within the lock member, and discharging the releasing hydraulic pressure to the outside, wherein the hysteresis is constituted by the purge valve mechanism. Thus, a part of hydraulic pressure applied to the engagement hole on releasing the lock member is discharged through the purge valve mechanism to outside the device to reduce hydraulic pressure acting the sliding of the lock member. Therefore, it can delay a release operation.

The purge valve mechanism may be a slide valve mechanism. Thus, a part of hydraulic pressure applied to the engagement hole on releasing the lock member is discharged through the slide valve mechanism to outside the device to reduce hydraulic pressure acting the sliding of the lock member. Therefore, it can delay a release operation.

The purge valve mechanism may be a check valve mechanism. Thus, a part of hydraulic pressure applied to the engagement hole on releasing the lock member is discharged through the check valve mechanism to outside the device to reduce hydraulic pressure acting the sliding of the lock member. Therefore, it can delay a release operation.

The purge valve mechanism may be a lead valve mechanism. Thus, a part of hydraulic pressure applied to the engagement hole on releasing the lock member is discharged through the lead valve mechanism to outside the device to reduce hydraulic pressure acting the sliding of the lock member. Therefore, it can delay a release operation.

The hysteresis may be constituted by a difference in the flow rate between pressurized fluids which are set by elasticity of the purge valve mechanism or a support member of the purge valve mechanism. Thus, limited oil flow relating to the release of the lock can delay a release operation.

The valve timing control device may comprise a first rotor rotating in synchronization with a crankshaft of an internal-combustion engine; a second rotor fixed.on an end of an intake camshaft or an exhaust camshaft of the internal-combustion engine and rotatably arranged in the first rotor; a lock member locking the first and second rotors at a required angle which the second rotor forms with the. first rotor; a backward pressure chamber arranged at any one of the first and second rotors, accommodating the lock member and a biasing member biasing the lock member, and having a discharge hole of discharging backward pressure of the lock member; an engagement hole arranged in the other, allowing insertion of the lock member, and having an oil hydraulic supply path supplying hydraulic pressure to release the lock member; and a release valve having an advance side pressure partition path communicating an advance side hydraulic pressure chamber and a retardation side pressure partition path communicating a retardation side hydraulic pressure chamber to selectively supply the highest hydraulic pressure in the both chambers to the oil hydraulic supply path, wherein releasing hydraulic pressure characteristics are provided with a hysteresis characterized in that releasing hydraulic pressure is larger than holding-releasing hydraulic pressure, the hysteresis is constituted by a difference in the flow rate between pressurized fluids from the advance side hydraulic pressure chamber and the retardation side hydraulic pressure chamber. Thus, limited oil flow relating to the release of the lock can delay a release operation.

The oil hydraulic supply path communicating the release valve may be divided into an advance side oil hydraulic supply path and a retardation side oil hydraulic supply path. The difference in the flow rate between pressurized fluids may be set by an opening area difference between the advance and retardation oil hydraulic supply paths. Thus, limited oil flow relating to the release of the lock can delay a release operation.

The difference in the flow rate between pressurized fluids may be set by an opening area difference between an advance side pressure partition path and a retardation side pressure partition path, the respective paths communicating with the release valve. Thus, limited oil flow relating to the release of the lock can delay a release operation.

The difference in the flow rate between pressurized fluids may be set by a difference in the length between an advance side pressure partition path and a retardation side pressure partition path, the respective paths communicating with the release valve. Thus, limited oil flow relating to the release of the lock can delay a release operation.

The difference in the flow rate between pressurized fluids may be set by a bending difference between an advance side pressure partition path and a retardation side pressure partition path, the respective paths communicating the release valve. Thus, limited oil flow relating to the release of the lock can delay a release operation.

BRIEF DESCRIPTION OF THE DRAWINGS

FIG. 4A and FIG. 4B are longitudinal cross sectional views of an internal construction of a valve timing control device as embodiment 1 according to the present invention, wherein FIG. 4A shows a locked state, and FIG. 4B shows a released state.

FIG. 5A and FIG. 5B are longitudinal cross sectional views of an internal construction of a valve timing control device as embodiment 2 according to the present invention, wherein FIG. 5A shows a locked state, and FIG. 5B shows a released state.

FIG. 6A and FIG. 6B are longitudinal cross sectional views of an internal construction of a valve timing control device as embodiment 3according to the present invention, wherein FIG. 6A shows a locked state, and FIG. 6B shows a released state.

FIG. 7A and FIG. 7B are longitudinal cross sectional views of an internal construction of a valve timing control device as embodiment 4 according to the present invention, wherein FIG. 7A shows a locked state, and FIG. 7B shows a released state.

FIG. 8A is a longitudinal cross sectional view of the release valve. FIG. 8B is a lateral cross sectional view of the release valve on application of an advance hydraulic pressure. FIG. 8C is a lateral cross sectional view showing the release valve on application a retardation hydraulic pressure.

FIG. 9A shows release hydraulic pressure characteristics on application of a retardation hydraulic pressure. FIG. 9B shows release hydraulic pressure characteristics on application of an advance hydraulic pressure.

FIG. 10A is a longitudinal cross sectional view of the release valve. FIG. 10B is a lateral cross sectional view of the release valve on application of an advance hydraulic pressure. FIG. 10C is a lateral cross sectional view of the release valve on application of a retardation hydraulic pressure.

FIG. 11A is a longitudinal cross sectional view of the release valve. FIG. 11B is a lateral cross sectional view of the release valve on application of an advance hydraulic pressure. FIG. 11C is a lateral cross sectional view of the release valve on application of a retardation hydraulic pressure.

DESCRIPTION OF THE PREFERRED EMBODIMENT OF THE INVENTION

Hereafter, one embodiment according to the present invention will be explained. Moreover, with the explanation of each embodiment, a lock member is arranged at a first rotor, and an engagement hole engaged with the lock member is arranged at a second rotor in accordance with the conventional example as shown in FIG. 1 to FIG. 3C. However, the present invention is not limited to such construction, and may be a reverse construction that the lock member is arranged at the second rotor, and that the engagement hole is arranged at the first rotor.

Embodiment 1

Figure 1:
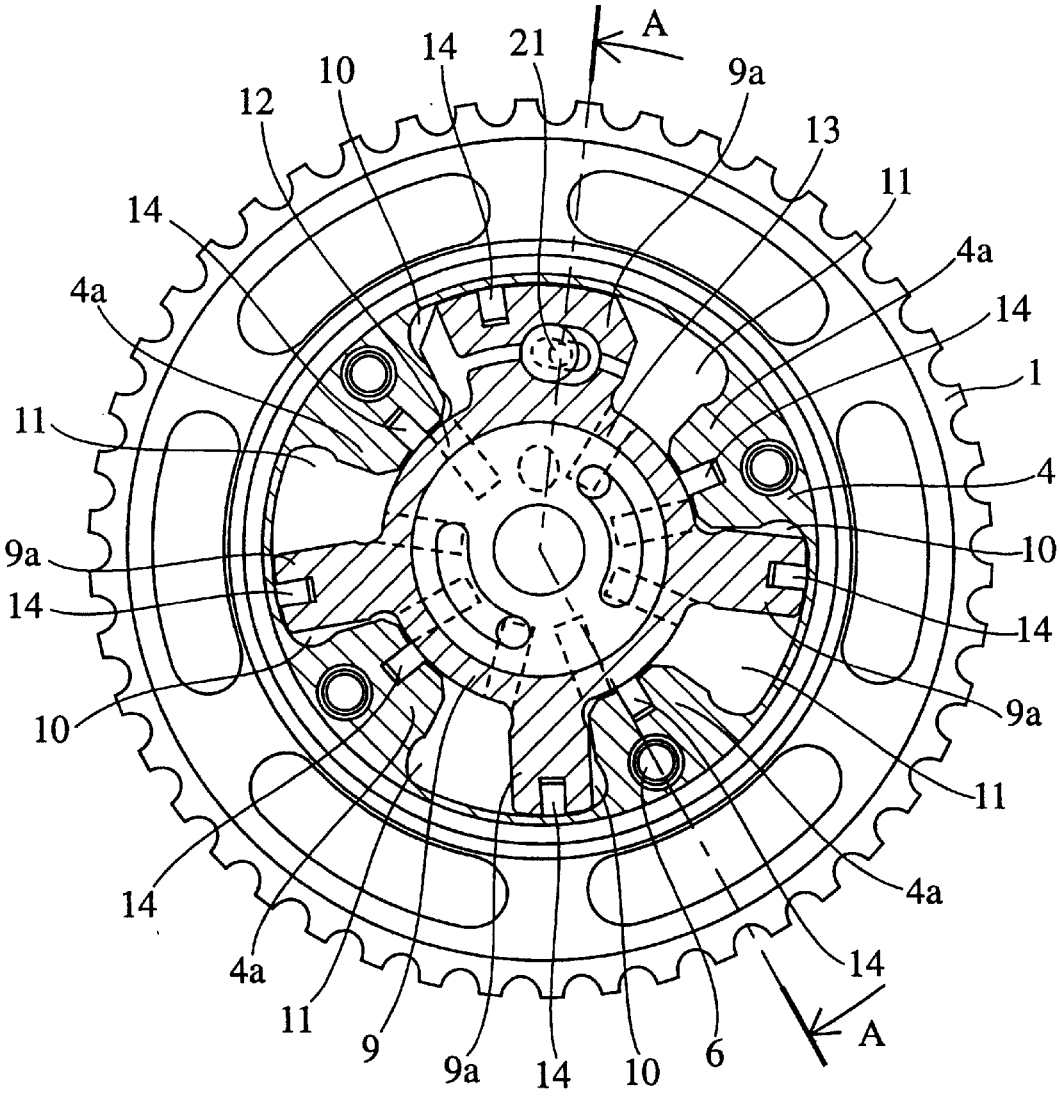
FIG.1 (PRIOR ART)
FIG. 1 is a lateral cross-sectional view of an internal construction of a conventional vane-type valve timing control device.
Figure 2:
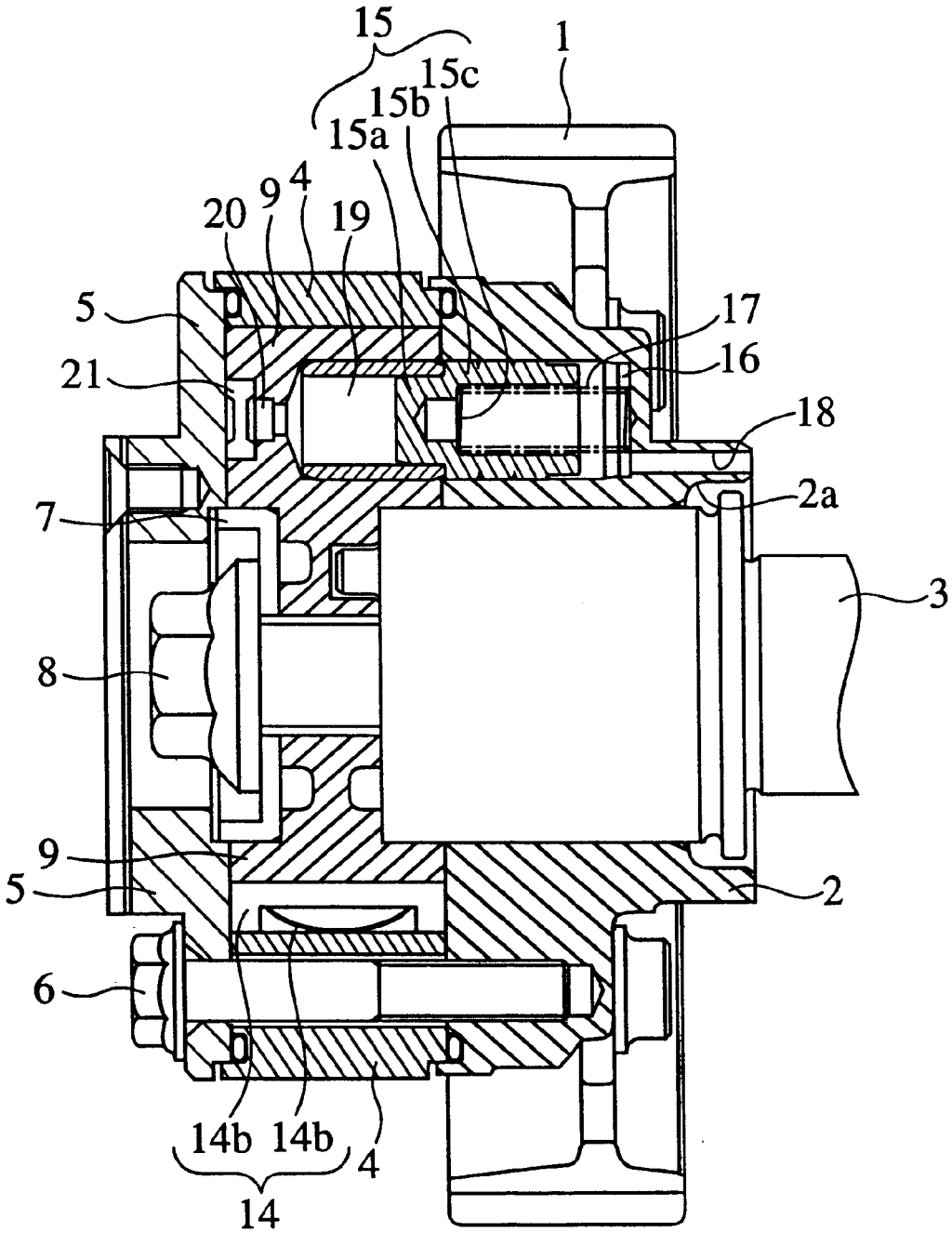
FIG.2 (PRIOR ART)
FIG. 2 is a longitudinal cross sectional view taken along lines A—A of FIG. 1.
Figure 3A:
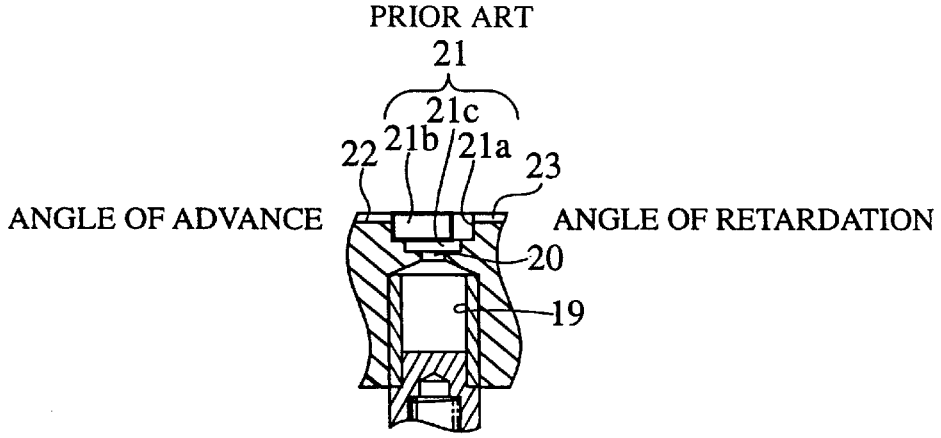
FIG.3A PRIOR ART
FIG. 3A is an enlarged longitudinal cross sectional view of a release valve in the conventional valve timing control device shown in FIG. 1 and FIG. 2.
Figure 3B:
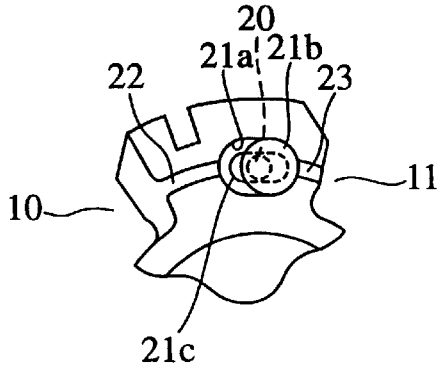
FIG.3B PRIOR ART
FIG. 3B is an enlarged lateral cross sectional view of the state of the release valve on application of advance hydraulic pressure.
Figure 3C:
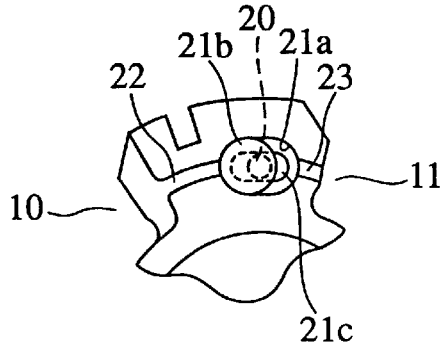
FIG.3C PRIOR ART
FIG. 3C is an enlarged lateral cross sectional view of the state of the release valve on application of retardation hydraulic pressure.
Figure 4B:
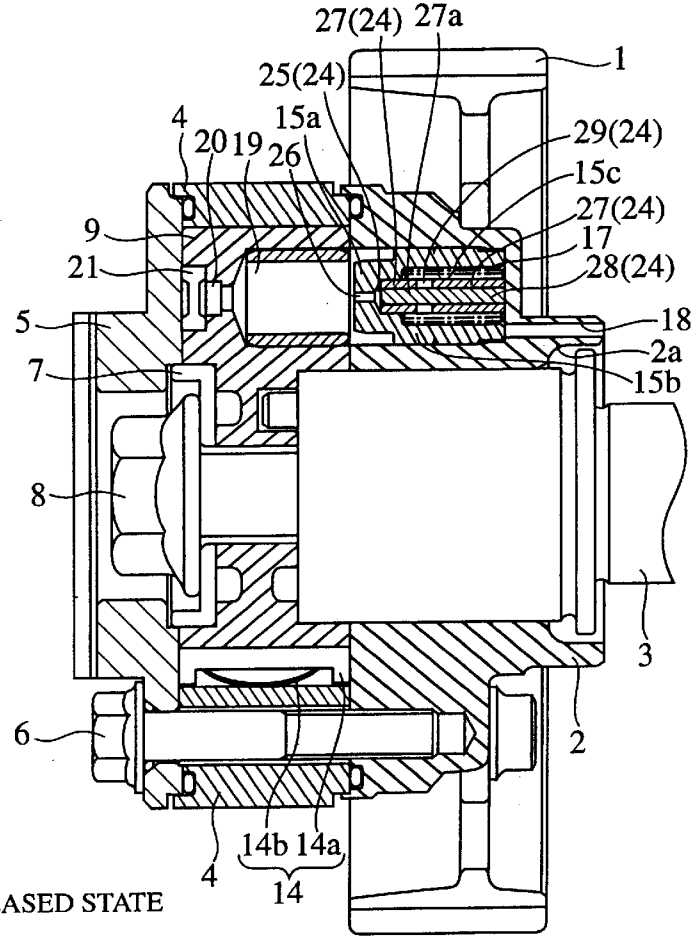
Figure 4A:
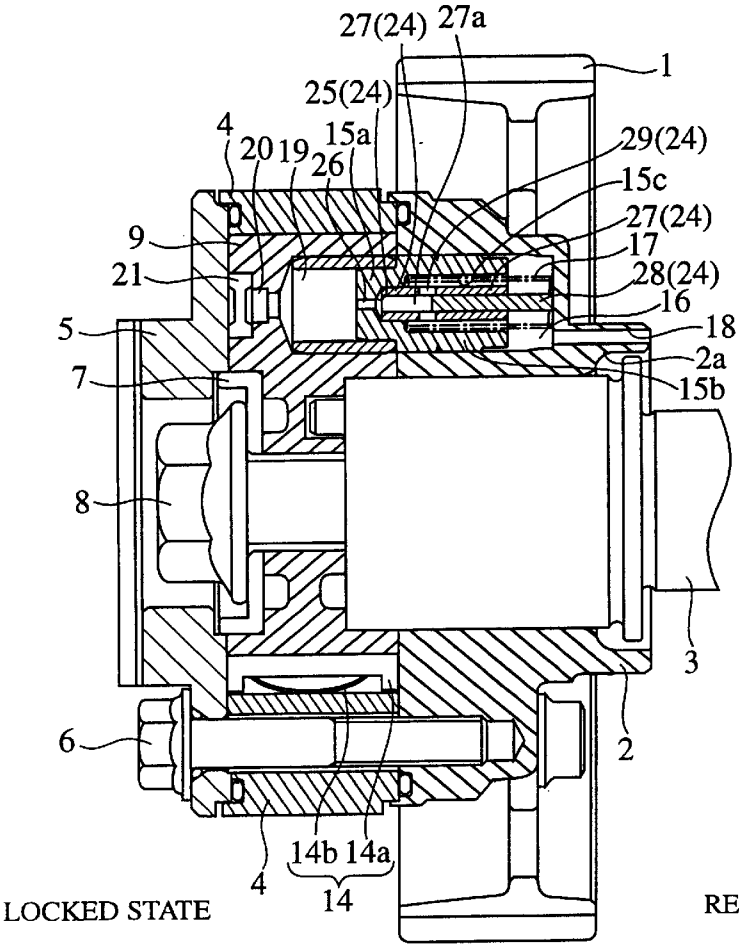

FIG. 4A and FIG. 4B are longitudinal cross sectional views of an internal construction of a valve timing control device as embodiment 1 according to the present invention, wherein FIG. 4A shows a locked state, and FIG. 4B shows a released state. Those components of the embodiment 1 of the present invention which are the same as those of the conventional valve timing control device as shown in FIG. 1 to FIG. 3 are denoted by the same reference numerals and further description will be omitted.

The embodiment 1 is characterized in that a purge valve 24 is arranged about the lock pin 15. The purge valve 24 is opened on starting a release operation to discharge the air-mixing oil through the discharge hole to outside the device. The purge valve 24 is a slide valve mechanism, and includes a recess part 25, a communication hole 26, a bush 27, a slide pin 28 and a purge path 29. The recess part 25 is formed at a bottom of the hole 15*c* of the lock pin 15. The communication hole 26 is formed at a central portion of the small radius part 15*a* of the lock pin 15 to communicate the engagement hole 19 with the recess part 25. The bush 27 is press-fitted into the recess part 25 and has an inner hole 27*a*. The slide pin 28 is formed to project on a rear wall of the backward pressure chamber 16 in a direction of sliding axis and inserted into the inner hole 27*a* of the bush 27. The purge path 29 communicates the inner hole 27*a* of the bush 27 with the hole 15*c*. The purge path 29 is formed at a position where the inner hole 27*a* communicates with the hole 15*c* with a lock state as shown in FIG. 4A.

Next, the release operation will be explained.

First, the engine starts to activate the oil pump (not shown) to supply hydraulic pressure to the pipe arrangement such as the first oil path 12 and the second oil path 13. The hydraulic pressure mixes with accumulated air in the pipe arrangement which is supplied to the advance side hydraulic pressure chamber 10 and the retardation side hydraulic pressure chamber 11. The air-mixing oil is applied in the engagement hole 19 of the rotor 9 as the second rotor through the release valve 21, the oil hydraulic supply path 20 and soon. The first applied hydraulic pressure mixing air is compressive, pressurized fluid with low viscosity which presses the small radius part 15*a* and the large radius part 15*b* of the lock pin 15 as shown in FIG. 4A in a release direction. Here, the biasing force of the biasing member 17 is applied to the lock pin 15, and the slide pin 28 is reciprocally slid to house in the inner hole 27*a* of the bush 27. Therefore, the slide pin 28 moves (releases) in the release direction at timing earlier than the lock pin 15 to open the purge path 29 under the hydraulic pressure. A part of the hydraulic pressure is discharged through the communication hole 26 of the lock pin 15, the recess part 25, the inner hole 27*a* of the bush 27, the purge path 29 and the discharge hole 18 of the backward pressure chamber 16 to the outside. The discharged hydraulic pressure has little effect on a release operation. With the embodiment 1, since the lock pin 15 is slowly slid in the release direction as compared with the conventional construction, it can delay a release operation. Further, it is necessary to release under a release hydraulic pressure higher than that of the conventional construction having no purge valve as described above with using the same biasing force.

Next, air as compressive, pressurized fluid mixed in oil on application is generally discharged through the purge path 29 and the discharge hole 18 to outside the device, and oil as non-compressive, pressurized fluid having high viscosity is occupied in the pipe arrangement. Therefore, viscous resistance is increased in narrow oil paths such as the communication hole 26 and so on to reduce the overall amount of discharged oil and to bring loss of hydraulic pressure. As a result, since a release hydraulic pressure in the engagement hole 19 and a supply hydraulic pressure after starting the engine are increased, as shown in FIG. 4B, the lock pin 15 is slid in the release direction to insert into the backward pressure chamber 16. Moreover, the purge path 29 is set to be closed by the slide pin 28 before the end of a release operation, and a holding-release hydraulic pressure can be lower than the release hydraulic pressure which creates hydraulic pressure characteristics comprising a hysterersis.

Next, a lock operation will be explained.

Next about locking, since the oil pump (not shown) stops to downwardly move oil in the advance side hydraulic pressure chamber 10, the retardation side hydraulic pressure chamber 11 and the respective pipe arrangement to the oil-pan (not shown), hydraulic pressure in the engagement hole 19 is reduced. Here, the lock pin 15 is slid in a lock direction by the biasing force of the biasing member 17 to engage with the engagement hole 19. As a result, the first rotor and the second rotor are locked to restrict the free rotation between them as shown in FIG. 4A. In this case, the engagement speed of the lock pin 15 is nearly equal to that of the conventional valve timing control device. The slide pin 24 is furthermore released from the inner hole 27*a* of the bush 27 in a lock operation, and the purge path 29 communicates the engagement hole 19 with the backward pressure chamber 16 to open the purge valve 24. In this case that the slide pin 28 is not released from the inner hole 27*a* of the bush 27 in a lock operation, the purge valve 24 can be similarly opened in a release operation.

As described above, according to the embodiment 1, a part of hydraulic pressure applied to the engagement hole 19 in a release operation can be discharged through the purge valve 24 to reduce hydraulic pressure acting the sliding of the lock pin 15. Thus, when hydraulic pressure rises on starting the engine, the lock pin 15 is not quickly released, and is released after applying hydraulic pressure which is able to control the valve timing control device. Therefore, it can prevent the occurrence of beat noise (abnormal noise).

According to the embodiment 1, the purge valve 24 can be easily opened and closed under a boundary condition of required pressure or difference in the flow rate (the flow rate) to simplify structure thereof.

According to the embodiment 1, since the purge valve 24 can be opened and closed in each lock operation, a self-cleaning operation can be performed to avoid risk of seizing due to foreign material or sludge.

Embodiment 2

Figure 5B:
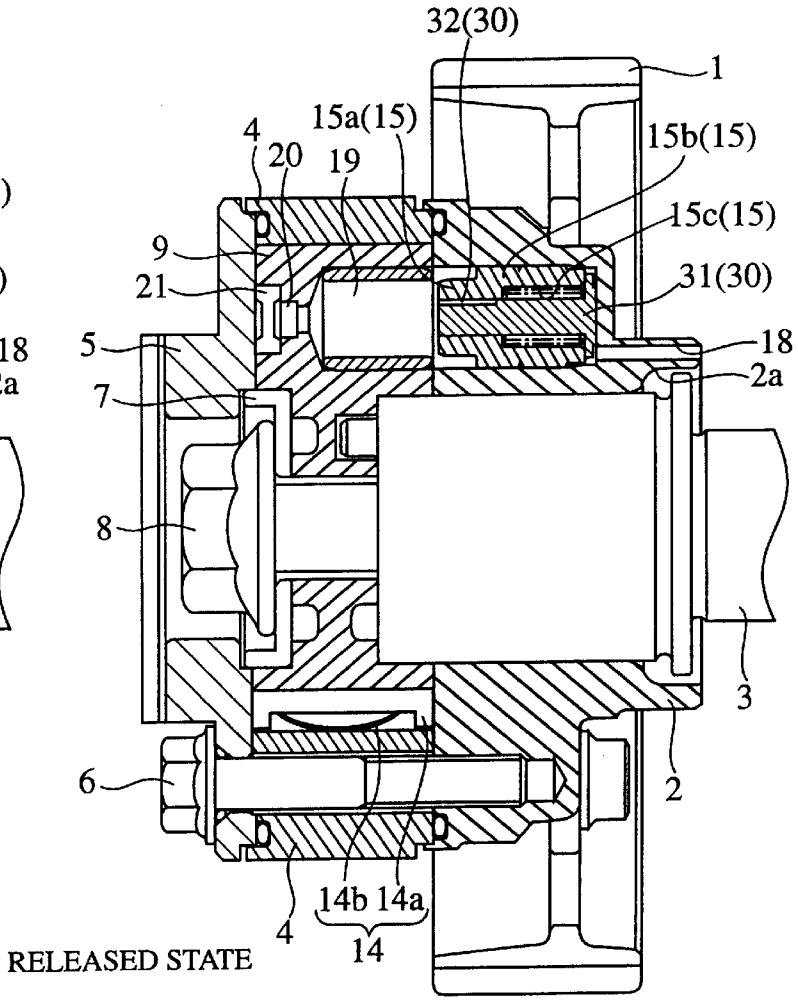
Figure 5A:
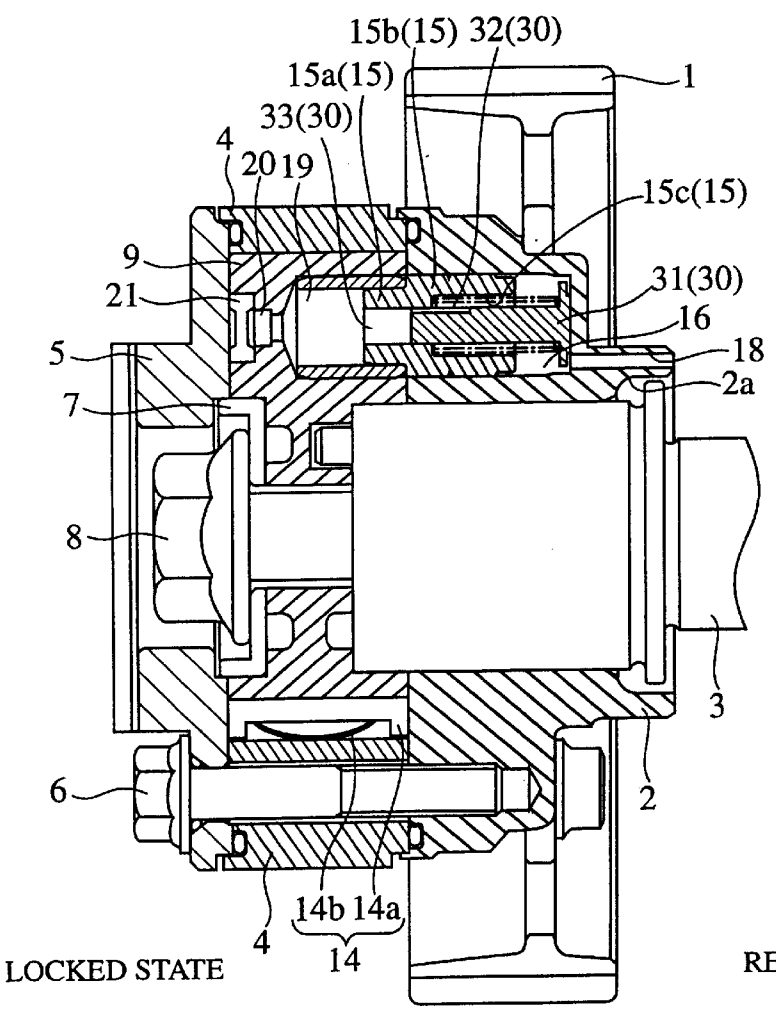

FIG. 5A and FIG. 5B are longitudinal cross sectional views of an internal construction of a valve timing control device as embodiment 2 according to the present invention, wherein FIG. 5A shows a locked state, and FIG. 5B shows a released state. Those components of the embodiment 2 of the present invention which are the same as those of the embodiment 1 are denoted by the same reference numerals and further description will be omitted.

The embodiment 2 is characterized in that a purge valve 30 having a different construction from the purge valve 24 of the embodiment 1 is arranged about the lock pin 15. The purge valve 30 is a slide valve mechanism, and includes a slide member 31, a groove part 32 and a perforation hole 33. The slide member 31 is disposed at the rear wall of the backward pressure chamber 16, and has a projection which projects in a direction of sliding axis and which has an outer diameter smaller than an inner diameter of the hole 15*c*. The groove part 32 is formed at an outer rim of the slide member 31 from front end thereof to a center thereof in the direction of sliding axis. The perforation hole 33 is formed in the small radius part 15*a* of the lock pin 15 so as to communicate the engagement hole 19 with the hole 15*c*, and allows insertion of the front end of the slide member 31. A base of the slide member 31 has an outer diameter smaller than an inner diameter of the backward pressure chamber 16. The biasing member 17 is arranged between an upper face of the base of the slide member 31 and the bottom of the hole 15*c*.

Next, a release operation will be explained.

First, the engine starts to activate the oil pump (not shown) to supply hydraulic pressure to the pipe arrangement such as the first oil path 12 and the second oil path 13. The hydraulic pressure mixes with accumulated air in the pipe arrangement which is supplied to the advance side hydraulic pressure chamber 10 and the retardation side hydraulic pressure chamber 11. The air-mixing oil is applied in the engagement hole 19 of the rotor 9 as the second rotor through the release valve 21, the oil hydraulic supply path 20 and so on. The first applied hydraulic pressure mixing air is compressive, pressurized fluid with low viscosity which presses the small radius part 15*a* and the large radius part 15*b* of the lock pin 15 as shown in FIG. 5A in a release direction. A part of the hydraulic pressure is discharged through the perforation hole 33 of the lock pin 15, the groove part 32 of the slide member 31, the hole 15*c*, the backward pressure chamber 16, a peripheral portion of the base of the slide member 31 to the outside. The discharged hydraulic pressure has little effect on the release operation. With the embodiment 2, since the lock pin 15 is slowly slid in the release direction as compared with the conventional construction, it can delay a release operation. Further, it is necessary to release under a release hydraulic pressure higher than that of the conventional construction having no purge valve as described above with using the same biasing force.

Next, air as compressive, pressurized fluid mixed in oil on application is generally discharged through the purge valve 30 and the discharge hole 18 to the outside of the device, and oil as non compressive, pressurized fluid having high viscosity is occupied in the pipe arrangement. Therefore, viscous resistance is changed in narrow oil paths such as the perforation hole 33 and so on and a supply hydraulic pressure is increased after starting the engine. As a result, the lock pin 15 is slid in the release direction to insert into the backward pressure chamber 16 as shown in FIG. 5B. Moreover, the groove part 32 is set to be closed by an inner peripheral face of the perforation hole 33 before the end of the release operation, and a holding-release hydraulic pressure can be lower than the release hydraulic pressure which creates release hydraulic pressure characteristics comprising a hysterersis.

Next, a lock operation will be explained.

Next about locking, since the oil pump (not shown) stops to downwardly move oil in the advance side hydraulic pressure chamber 10, the retardation side hydraulic pressure chamber 11 and the respective pipe arrangement to the oil-pan (not shown), hydraulic pressure in the engagement hole 19 is reduced. Here, the lock pin 15 is slid in a lock direction by a biasing force of the biasing member 17 to engage with the engagement hole 19. As a result, the first rotor and the second rotor are locked to restrict the free rotation between them as shown in FIG. 5A. In this case, the engagement speed of the lock pin 15 is nearly equal to that of the conventional valve timing control device. Closing the groove part 32 by the perforation hole 33 is released in the lock operation to communicate the backward pressure chamber 16 with the engagement hole 19 in order to open the purge valve 30.

As described above, according to the embodiment 2, a part of an hydraulic pressure applied to the engagement hole 19 in a release operation can be discharged through the purge valve 30 to reduce hydraulic pressure acting the sliding of the lock pin 15. Thus, when hydraulic pressure rises on starting the engine, the lock pin 15 is not quickly released, and is released after applying hydraulic pressure which is able to control the valve timing control device. Therefore, it can prevent the occurrence of beat noise (abnormal noise).

According to the embodiment 2, the purge valve 30 can be easily opened and closed under a boundary condition of required pressure or difference in the flow rate (the flow rate), and can simplify structure thereof.

According to the embodiment 2, since the purge. valve 30 can be opened and closed in each lock operation, a self-cleaning operation can be performed to avoid risk of seizing due to foreign material or sludge.

Embodiment 3

Figure 6B:
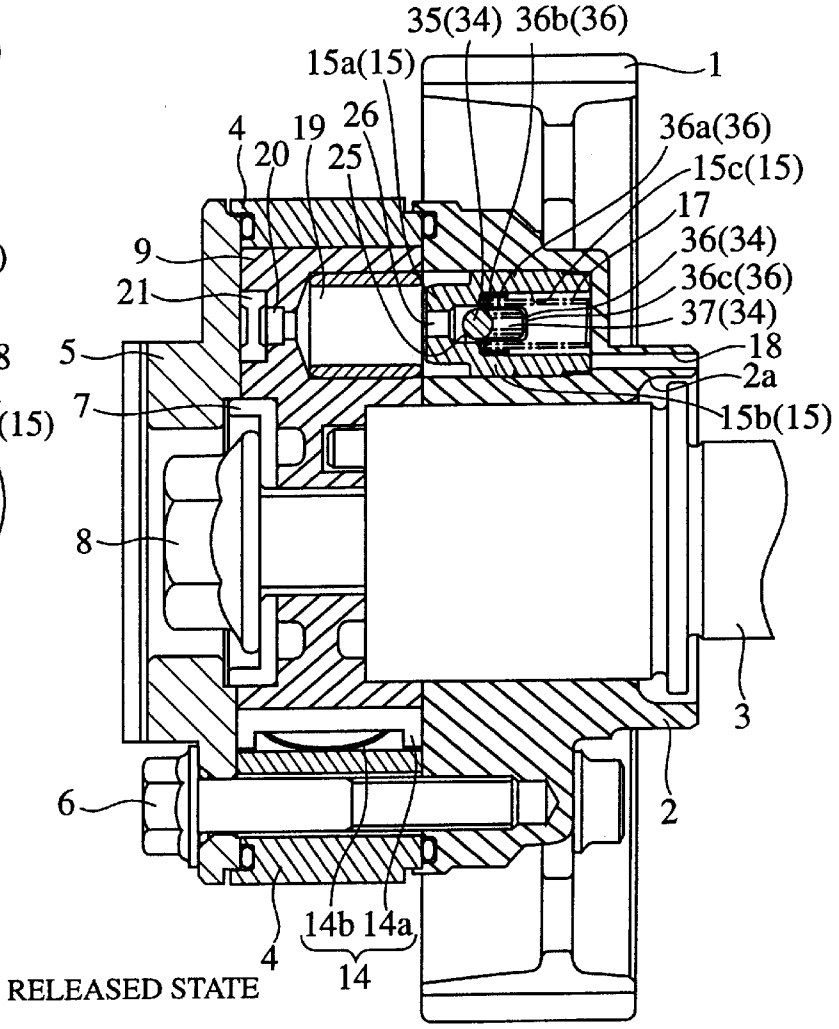
Figure 6A:
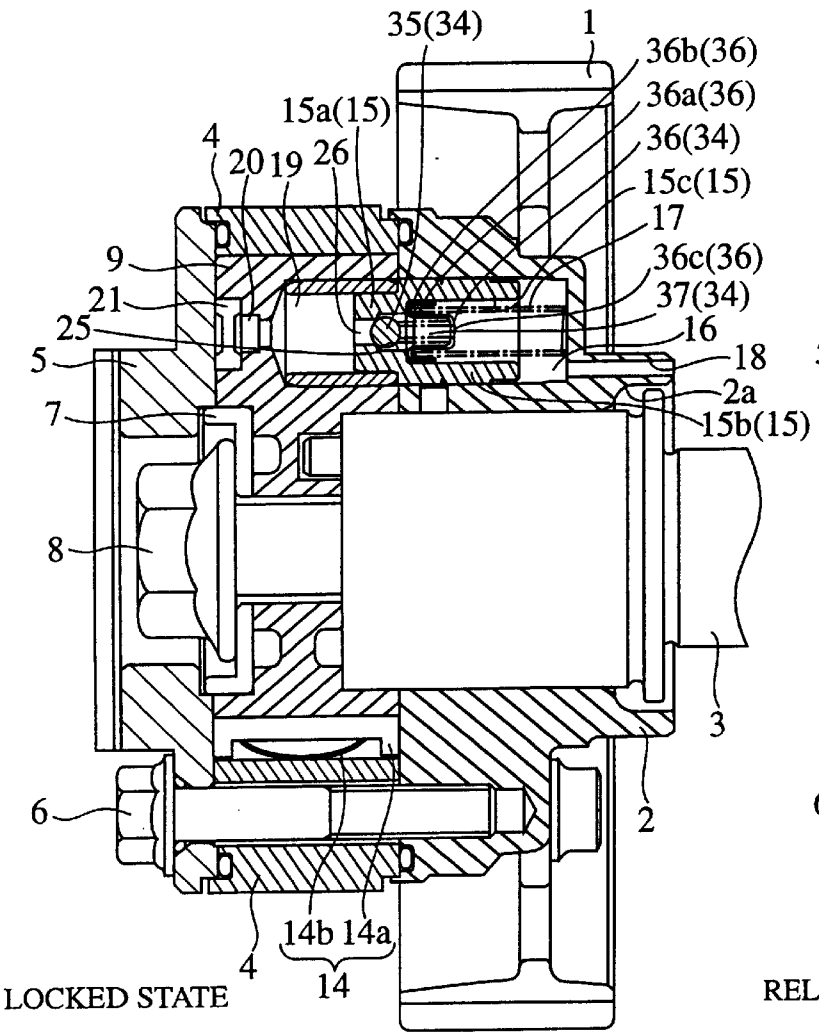

FIG. 6A and FIG. 6B are longitudinal cross sectional views of an internal construction of a valve timing control device as embodiment 3 according to the present invention, wherein FIG. 6A shows a locked state, and FIG. 6B shows a released state. Those components of the embodiment 3 of the present invention which are the same as those of the embodiment 1 are denoted by the same reference numerals and further description will be omitted.

The embodiment 3 is characterized in that a purge valve 34 having different construction from the purge valve 24 of the embodiment 1 is arranged about the lock pin 15. The purge valve 34 is a check valve mechanism, and includes a ball 35, a guide 36 and a biasing member 37 such as coil springs. The ball 35 is housed in the recess part 25 formed at the bottom of the hole 15*c* of the lock pin 15. The guide 36 is arranged at the bottom of the hole 15*c,* and has a letter shape in cross section, and includes a central part 36*a,* a lower end 36*b* and a hole 36*c*. The central part 36*a* projects toward the backward pressure chamber 16 when the purge valve 34 is arranged at the bottom of the hole 15*c*. The lower end 36*b* outwardly extends from a base of the central part 36*a* in a radius direction, and functions as a valve sheet for the ball 35. The hole 36*c* is formed at the central part 36*a*. The biasing member 37 is arranged between the central part 36*a* of the guide 36 and the ball 35. The biasing member 17 is arranged between the lower end 36*b* of the guide 36 and the rear wall of the backward pressure chamber 16.

Next, a release operation will be explained.

First, the engine starts to activate the oil pump (not shown) to supply hydraulic pressure to the pipe arrangement such as the first oil path 12 and the second oil path 13. The hydraulic pressure mixes with accumulated air in the pipe arrangement which is supplied to the advance side hydraulic pressure chamber 10 and the retardation side hydraulic pressure chamber 11. The air-mixing oil is applied in the engagement hole 19 of the rotor 9 as the second rotor through the release valve 21, the oil hydraulic supply path 20 and soon. The first applied hydraulic pressure mixing air is compressive, pressurized fluid with low viscosity to press the small radius part 15*a* and the large radius part 15*b* of the lock pin 15 as shown in FIG. 6A in a release direction. A part of the hydraulic pressure is passed through the communication hole 26 of the lock pin 15, a clearance between the communication hole 26 and the ball 35, the recess part 25, the hole 15*c,* the hole 36*c* and the backward pressure chamber 16 to discharge from the discharge hole 18 to the outside. The discharged hydraulic pressure has little effect on a release operation. Next, when the ball 35 moves toward the guide 36 under required release hydraulic pressure to seat on the lower end 36*b,* the release hydraulic pressure is not discharged. As a result, the lock pin 15 is slid in the release direction under the release hydraulic pressure to insert into the backward pressure chamber 16 as shown in FIG. 6B.

With the embodiment 3, since the lock pin 15 is slowly slid in the release direction by the purge valve 34, it can delay a release operation as compared with the conventional construction. Further, it is necessary to release under a release hydraulic pressure higher than that of the conventional construction having no purge valve 34 as described above. Since the ball 35 comes into contact with the lower end 36*b* of the guide 36 to close the hole 36*c* of the guide 35 before end of a release operation, a holding-release hydraulic pressure can be lower than the release hydraulic pressure which creates a release hydraulic pressure characteristics comprising a hysteresis.

Next, a lock operation will be explained.

Next about locking, since the oil pump (not shown) stops to downwardly move oil in the advance side hydraulic pressure chamber 10, the retardation side hydraulic pressure chamber 11 and the respective pipe arrangement to the oil-pan (not shown), hydraulic pressure in the engagement hole 19 is reduced. Here, the lock pin 15 is slid in a lock direction by the biasing force of the biasing member 17 to engage with the engagement hole 19. As a result, the first rotor and the second rotor are locked to restrict the free rotation between them as shown in FIG. 6A. In this case, the engagement speed of the lock pin 15 is nearly equal to that of the conventional valve timing control device.

As described above, according to the embodiment 3, a part of hydraulic pressure applied to the engagement hole 19 in a release operation can be discharged through the purge valve 34 to reduce hydraulic pressure acting the sliding of the lock pin 15. Thus, when hydraulic pressure rises on starting the engine, the lock pin 15 is not quickly released, and is released after applying hydraulic pressure which is able to control the valve timing control device. Therefore, it can prevent the occurrence of beat noise (abnormal noise).

According to the embodiment 3, oil dynamic pressure or the flow rate allows selection between opening and closing of the purge valve 34. For example, since a sufficient amount of compressed fluid is supplied under high pressure on starting the engine and has a low viscosity, dynamic pressure acting in operation of closing the purge valve 34 is sufficiently smaller than static pressure on acting on the purge valve 34. Thus, since the purge valve 34 can be controlled not to close until application of non-compressive pressurized fluid having high viscosity, a sufficient amount of compressed air in the fluid can be discharged. When the purge valve 34 is closed at once, the close state can be kept under the static pressure acting the area subjected to hydraulic pressure. Since a large hysteresis can be set under the static pressure, and the dynamic pressure, the static pressure keeping the close state can be set to a very small amount.

According to the embodiment 3, the purge valve 34 can be easily opened and closed under a boundary condition of required pressure or difference in the flow rate (the flow rate), and can simplify structure thereof.

According to the embodiment 3, since the purge valve 34 can be opened and closed in each lock operation, a self-cleaning operation can be performed to avoid risk of seizing due to foreign material or sludge.

Embodiment 4

Figure 7B:
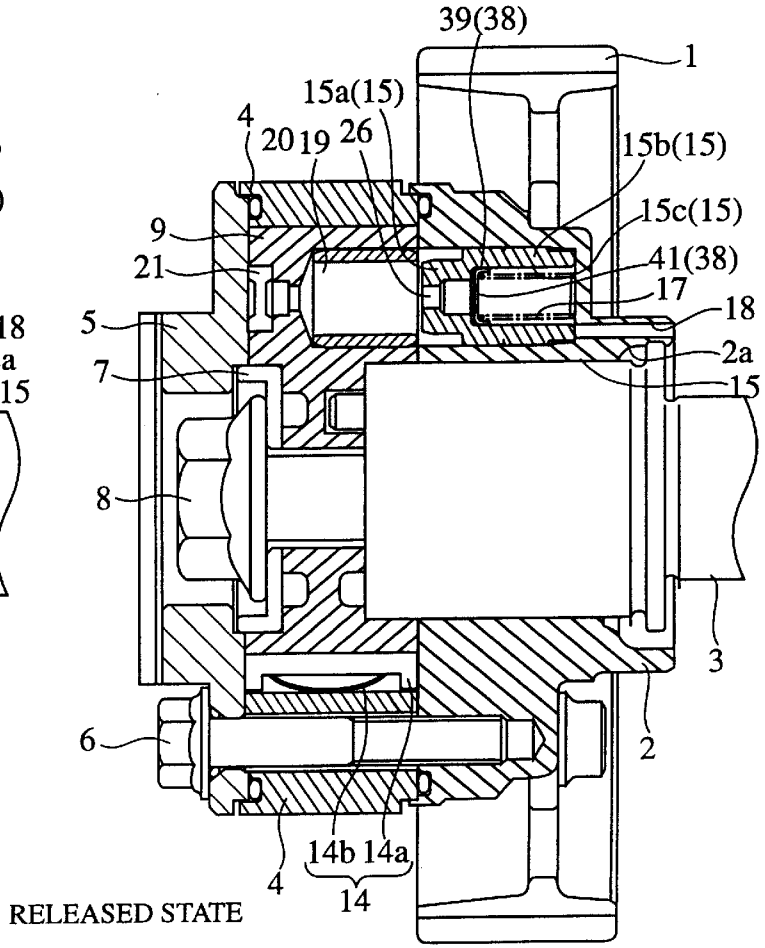
Figure 7A:
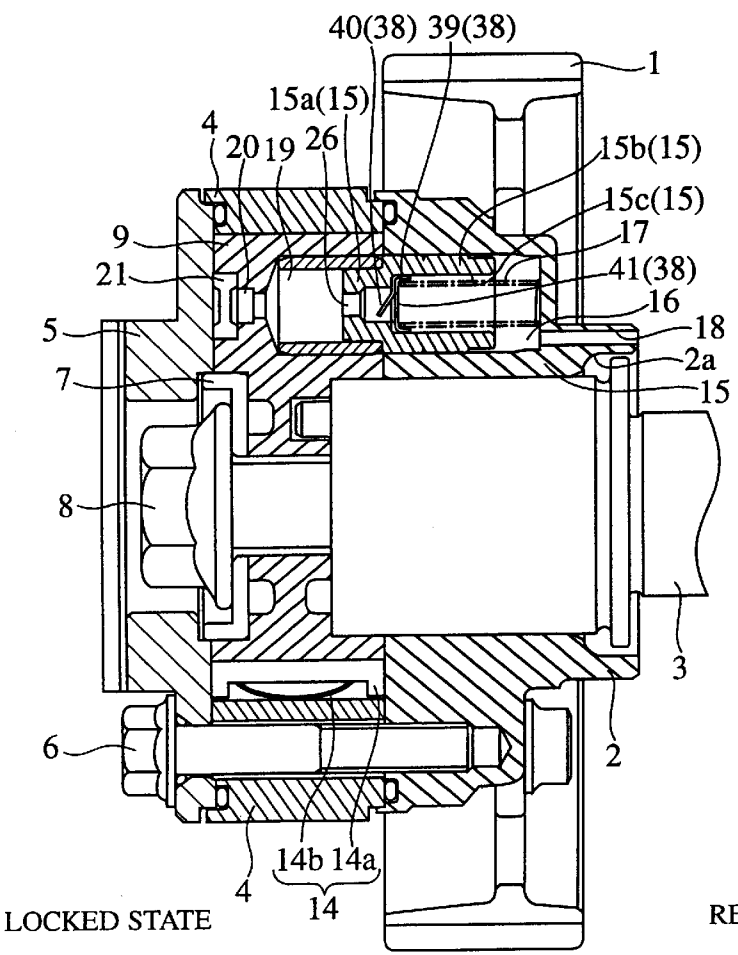

FIG. 7A and FIG. 7B are longitudinal cross sectional views of an internal construction of a valve timing control device as embodiment 4 according to the present invention, wherein FIG. 7A shows a locked state, and FIG. 7B shows a released state. Those components of the embodiment 4 of the present invention which are the same as those of the embodiment 1 are denoted by the same reference numerals and further description will be omitted.

The embodiment 4 is characterized in that a purge valve 38 having a different construction from the purge valve 24 of the embodiment 1 and so on is arranged about the lock pin 15. The purge valve 38 is a lead valve mechanism, and a valve seat 39 and an open/close valve 40. The valve seat 39 is arranged in the bottom of the hole 15*c* of the lock pin 15. The open/close valve 40 is formed as a cantilever spring at a peripheral portion of the valve seat 39, and is made of an elastic material such as a plate spring and so on. A perforation hole 41 is formed at a central portion of the valve seat 39 to communicate the recess part 25 of the lock pin 15 with the hole 15*c*. The open/close valve 40 closes the perforation hole 41 on release of the lock. The biasing member 17 is arranged between the bottom of the hole 15*c* and the rear wall of the backward pressure chamber 16.

Next, a release operation will be explained.

First, the engine starts to activate the oil pump (not shown) to supply hydraulic pressure to the pipe arrangement such as the first oil path 12 and the second oil path 13. The hydraulic pressure mixes with accumulated air in the pipe arrangement which is supplied to the advance side hydraulic pressure chamber 10 and the retardation side hydraulic pressure chamber 11. The air-mixing oil is applied in the engagement hole 19 of the rotor 9 which acts as the. second rotor through the release valve 21, the oil hydraulic supply path 20 and so on. The first applied hydraulic pressure mixing air is compressive, pressurized fluid with low viscosity which presses the small radius part 15*a* and the large radius part 15*b* of the lock pin 15 as shown in FIG. 7A in a release direction. A part of the hydraulic pressure is passed through the communication hole 26 or the lock pin 15, the recess part 25, the perforation hole 41 of the valve seat 39, the hole 15*c* and the backward pressure chamber 16 to discharge from the discharge hole 18 to the outside. The discharged hydraulic pressure has little effect on a release operation. Next, when the open/close valve 40 closes the perforation hole 41 under a required release hydraulic pressure, the release hydraulic pressure is not discharged. As a result, the lock pin 15 is slid in the release direction under the release hydraulic pressure to insert into the backward pressure chamber 16 as shown in FIG. 7B.

With the embodiment 4, since the lock pin 15 is slowly slid in the release direction by the purge valve 38, it can delay a release operation as compared with the conventional construction. Further, it is necessary to release under a release hydraulic pressure higher than that of the conventional construction having no purge valve 38 as described above. Since the open/close valve 40 closes the perforation hole 41 of the valve seat 39 under a release hydraulic pressure before the end of a release operation, a holding-release hydraulic pressure can be lower than the release hydraulic pressure which creates release hydraulic pressure characteristics comprising a hysteresis.

Next, a lock operation will be explained.

Next about locking, since the oil pump (not shown) stops to downwardly move oil in the advance side hydraulic pressure chamber 10, the retardation side hydraulic pressure chamber 11 and the respective pipe arrangement to the oil-pan (not shown), hydraulic pressure in the engagement hole 19 is reduced. Here, the lock pin 15 is slid in a lock direction by the biasing force of the biasing member 17 to engage with the engagement hole 19. As a result, the first rotor and the second rotor are locked to restrict the free rotation between them as shown in FIG. 7A. In this case, the engagement speed of the lock pin 15 is nearly equal to that of the conventional valve timing control device.

As described above, according to the embodiment 4, a part of hydraulic pressure applied to the engagement hole 19 in a release operation can be discharged through the purge valve 38 to reduce the hydraulic pressure acting the sliding of the lock pin 15. Thus, when hydraulic pressure rises on starting the engine, the lock pin 15 is not quickly released, and is released after applying hydraulic pressure which is able to control the valve timing control device. Therefore, it can prevent the occurrence of beat noise (abnormal noise).

According to the embodiment 4, pressure (partial pressure) or elasticity allows selection between opening and closing of the purge valve 38. For example, when area subjected to hydraulic pressure of the open/close valve 40 of the purge valve 38 has a gradient with respect to the closed face, the effective area on starting the engine can be smaller than the real area. When the effective area-on closing is nearly equal to the real one, hydraulic pressure with respect to the open/close of the purge valve 38 can have a hysteresis. The hysteresis can be established by simple balance between stresses to easily design it.

According to the embodiment 4, since the purge valve 38 can be opened and closed in each lock operation, a self-cleaning operation can be performed to avoid risk of seizing due to foreign material or sludge.

The purge valve mechanism explained in the embodiments 1 to 4 may depend on pressure or difference in the flow rate (the flow rate) as a trigger of operation instead of viscosity of fluid. A close element may be separated from the discharge hole 18 to enlarge area of the discharge hole. For example, when a bending portion of the pipe arrangement for supplying oil the oil pump to the valve timing control device enlarges the volume of the pipe arrangement to increase air mixed with oil in volume, a volume of fluid can discharge to the outside without changing the closed state of the valve.

With the embodiments 1 to 4, the slide valve mechanism, the check valve mechanism and the lead valve mechanism are taken as an illustration of the purge valve mechanism. Any open/close mechanism, which is able to open and close under a boundary condition of required pressure or difference in the flow rate (the flow rate), may be used as the purge valve mechanism. The purge valve mechanism may open and close by change of viscosity of pressurized fluid.

Embodiment 5

Figure 8A:
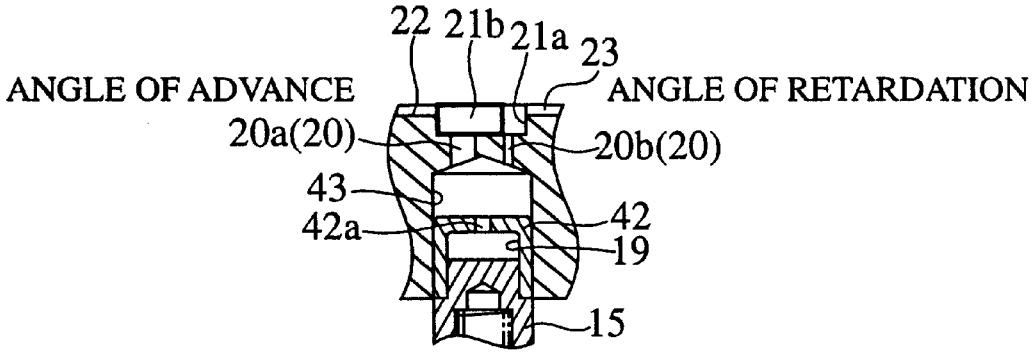
FIG. 8A, FIG. 8B and FIG. 8C show an internal construction of a release valve in a valve timing control device as embodiment 5 according to the present invention.
Figure 8B:
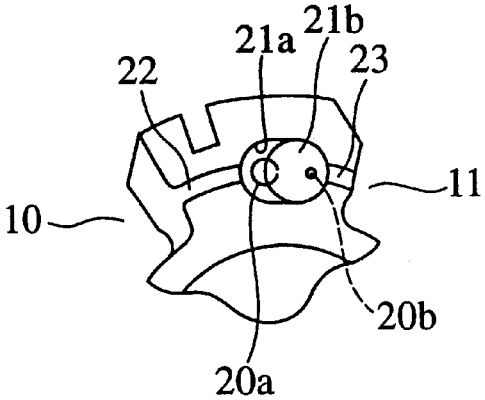
Figure 8C:
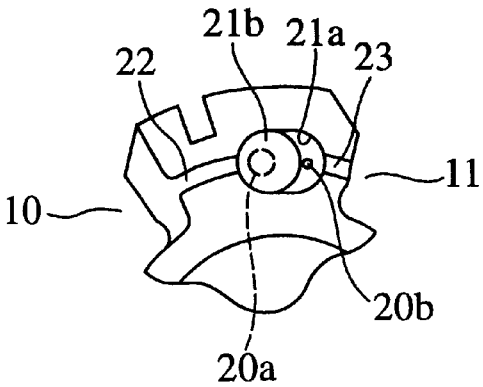
Figure 9A:
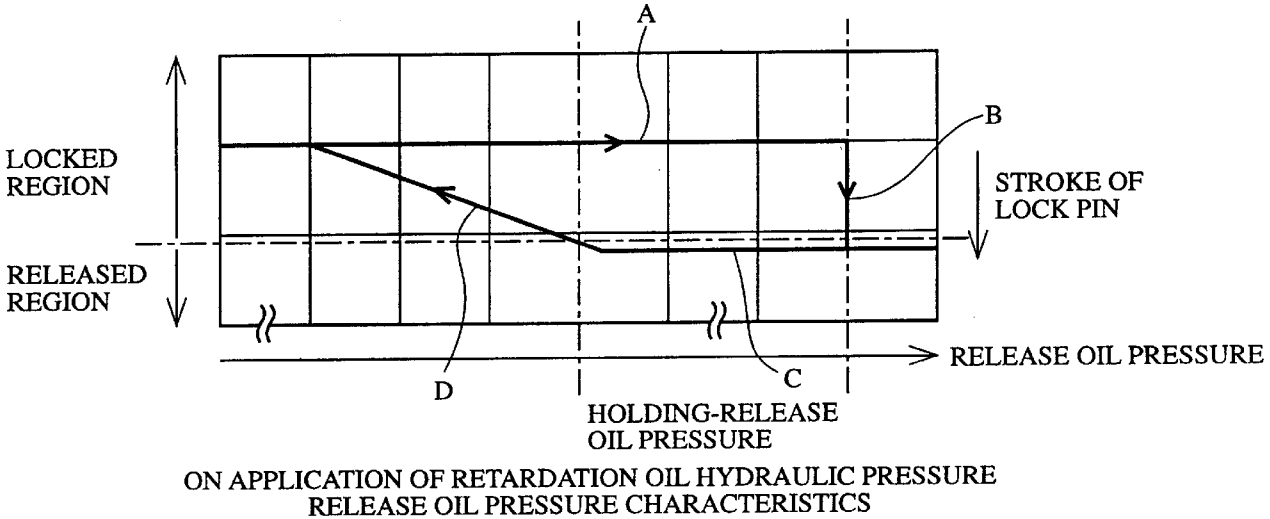
FIG. 9A and FIG. 9B are graphs of hysteresis characteristics shown in a lock operation in valve timing control device as embodiments 5 to 7 according to the present invention.
Figure 9B:
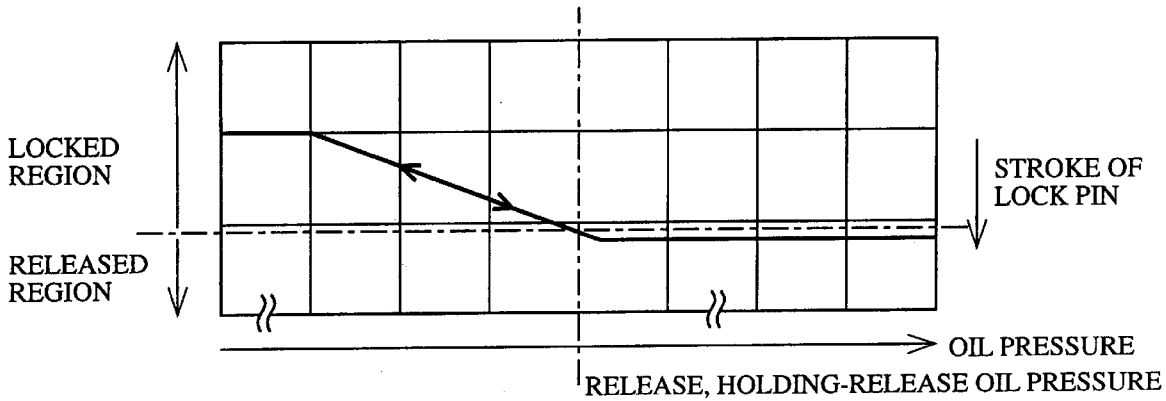

FIG. 8A, FIG. 8B and FIG. 8C show an internal construction of a release valve in a valve timing control device as embodiment 5 according to the present invention. FIG. 8A is a longitudinal cross sectional view of the release valve. FIG. 8B is a lateral cross sectional view of the release valve on application of advance hydraulic pressure. FIG. 8C is a lateral cross sectional view showing the release valve on application retardation hydraulic pressure. FIG. 9A and FIG. 9B are graphs of hysteresis characteristics shown in a lock operation in the valve timing control device as embodiments 5 to 7 according to the present invention. FIG. 9A shows release hydraulic pressure characteristics on application of the retardation hydraulic pressure. FIG. 9B shows release hydraulic pressure characteristics on application of advance hydraulic pressure. Those components of the embodiment 5 of the present invention which are the same as those of the embodiment 1 are denoted by the same reference numerals and further description will be omitted.

The embodiment 5 is characterized in that a periphery of the lock pin 15 is similar to the conventional construction, and that a choke is arranged in the oil hydraulic supply path 20. The choke brings loss of release hydraulic pressure in advance. In other words, with the embodiment 5, as shown in FIG. 8A, the oil hydraulic supply path 20 is divided into an advance side oil hydraulic supply path 20*a* and a retardation side oil hydraulic supply path 20*b*. The opening area of the retardation side oil hydraulic supply path 20*b* is smaller than that of the second oil path 13 corresponding to the path 20*b*. The opening area of the advance side oil hydraulic supply path 20*a* is equal to that of the first oil path 12 corresponding to the path 20*a*. An engagement member 42 has a perforation hole 42*a* formed at a bottom thereof, and is press-fitted into an engagement recess part 43 to constitute the engagement hole 19 in the embodiment 5.

Next, a release operation will be explained.

In a release operation, when a hydraulic pressure in the advance side hydraulic pressure chamber 10 is higher than a hydraulic pressure in the retardation side hydraulic pressure chamber 11, the slide plate 21*b* of the release valve 21 closes the retardation side pressure partition path 23 as shown in FIG. 8B. Thus, the slide plate 21*b* communicates the advance side pressure partition path 22 with the advance side oil hydraulic supply path 20*a* to apply a release hydraulic pressure to the engagement hole 19. In this case, the release hydraulic pressure does not bring loss with respect to the first oil path 12. The lock pin 15 is different from the embodiments 1 to 4, and is equal to the conventional construction. Thus, the release hydraulic pressure is equal to the holding-release hydraulic pressure as shown in FIG. 9B.

When the hydraulic pressure in the retardation side hydraulic pressure chamber 11 is higher than.the hydraulic pressure in the advance side hydraulic pressure chamber 10 in a release operation, the slide plate 21*b* of the release valve 21 closes the advance side pressure partition path 22 as shown in FIG. 8C. Thus, the slide plate 21*b* communicates the retardation side pressure partition path 23 with the retardation side oil hydraulic supply path 20*b* to apply release hydraulic pressure to the engagement hole 19. In this case, it creates a loss in the applied hydraulic pressure with respect to the second oil path 13 to reduce the overall amount of oil to the engagement hole 19. Since high release hydraulic pressure must be applied to slide the lock pin 15 in the release direction as shown by A of FIG. 9A, it can delay a release operation. The lock pin 15 is slid in the release direction under applied high hydraulic pressure as shown by B of FIG. 9A, and releases from the engagement hole 19 to perform the releasing operation. In order to hold the released state, although the holding-release hydraulic pressure is equal to the biasing force of the biasing member 17, the holding-release hydraulic pressure may be smaller than the release hydraulic pressure as shown by C of FIG. 9A. Next about locking, they can be slid by only the biasing force of the biasing member 17 as shown by D of FIG. 9A. As described above, with the embodiment 5, it can have release hydraulic pressure characteristics with a hysteresis.

As described above, according to the embodiment 5, since the choke is formed in the oil hydraulic supply path 20, it can bring loss of release hydraulic pressure in advance to reduce an overall amount of oil for the release operation, and can delay the release operation. Thus, when hydraulic pressure elevates on starting the engine, the lock pin 15 is not quickly released, and is released after applying hydraulic pressure which is able to control the valve timing control device. Therefore, it can prevent the occurrence of beat noise (abnormal noise).

According to the embodiment 5, a difference in the flow rate between release oil from the advance side hydraulic pressure chamber 10 and the retardation side hydraulic pressure chamber 11 is performed by the opening area difference there-between defined by the choke. Alternatively, the difference in the flow rate may be performed by length or bending difference of the oil paths.

Embodiment 6

Figure 10A:
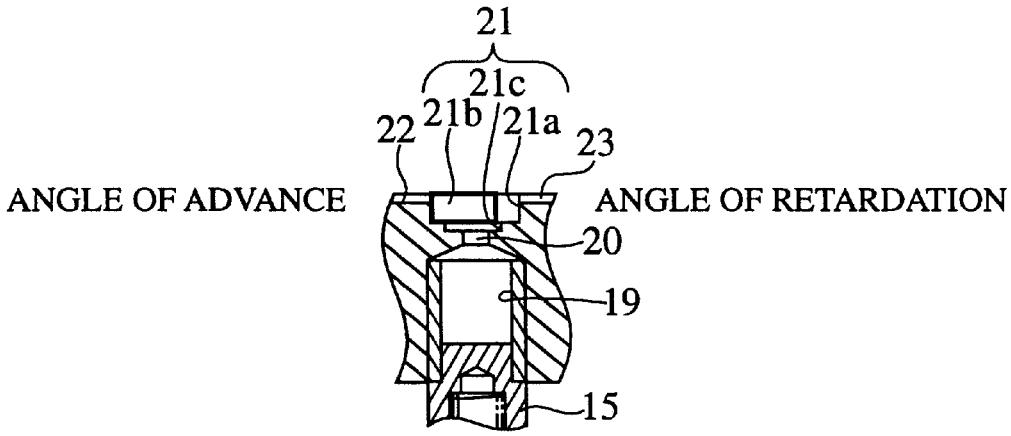
FIG. 10A, FIG. 10B, and FIG. 10C show an internal construction of a release valve in a valve timing control device as embodiment 6 according to the present invention.
Figure 10B:
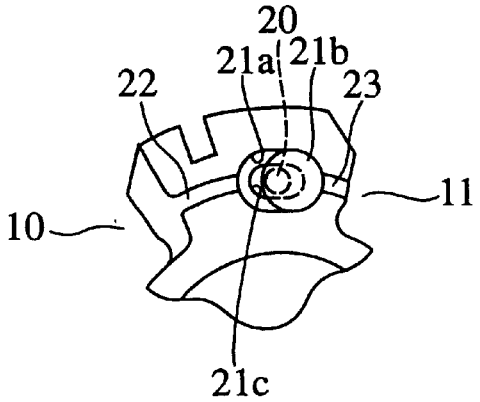
Figure 10C:
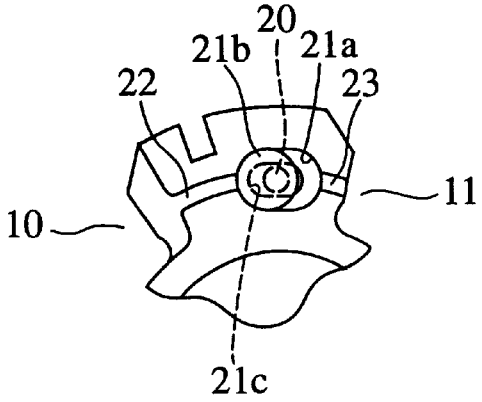

FIG. 10A, FIG. 10B, and FIG. 10C show an internal construction of a release valve in a valve timing control device as embodiment 6 according to the present invention. FIG. 10A is a longitudinal cross sectional view of the release valve. FIG. 10B is a lateral cross sectional view of the release valve on application of an advance hydraulic pressure. FIG. 10C is a lateral cross sectional view of the release valve on application of a retardation hydraulic pressure. Those components of the embodiment 6 of the present invention which are the same as those of the embodiment 1 are denoted by the same reference numerals and further description will be omitted. FIG. 9A and FIG. 9B also show hysteresis characteristics in a lock operation according to the embodiment 6 by reference here.

The embodiment 6 is characterized in that the periphery of the lock pin 15 and the oil hydraulic supply path are similar to the conventional construction, and that a choke of bringing loss of release hydraulic pressure in advance is arranged in the release valve 21. The choke is a minute opening formed between the slide plate 21*b* of the release valve 21 and the perforation hole 21*c* having an oval shape in cross section. The slide plate 21*b* moves toward the advance side when oil in the retardation side hydraulic pressure chamber 11 is higher. The minute opening is smaller than the opening area of the second oil path 13 for supplying hydraulic pressure the retardation side hydraulic pressure chamber 11. On the other hand, when hydraulic pressure in the advance side hydraulic pressure chamber 10 is higher, an area of opening defined between the slide plate 21*b* moving toward the retardation side and the perforation hole 2 is kept similar to the conventional construction.

Next, a release operation will be explained.

When hydraulic pressure in the advance side hydraulic pressure chamber 10 is higher a release operation, the slide plate 21*b* of the release valve 21 closes the retardation side pressure partition path 23 as shown in FIG. 10B. Thus, the slide plate 21*b* communicates the advance side pressure partition path 22 with the advance side oil hydraulic supply path 20*a* through a widespread opening defined between the slide plate 21*b* and the perforation hole 21*c* to apply release hydraulic pressure to the engagement hole 19. In this case, it does not create a loss in the release hydraulic pressure with respect to the first oil path 12. The lock pin 15 is different from the embodiments 1 to 4, and is equal to the conventional construction. Thus, the release hydraulic pressure is equal to the holding-release hydraulic pressure as shown in FIG. 9B.

When hydraulic pressure in the retardation side hydraulic pressure chamber 11 is higher in a release operation, the slide plate 21*b* of the release valve 21 moves toward the advance side to close the advance side pressure partition path 22 as shown in FIG. 10C. Thus, the slide plate 21*b* communicates the retardation side pressure partition path 23 with the retardation side oil hydraulic supply path 20*b* through the minute opening between the slide plate 21*b* and the perforation hole 21*c* to apply release hydraulic pressure to the engagement hole 19. In this case, it creates a loss in applied hydraulic pressure with respect to the second oil path 13. Since high release hydraulic pressure must be applied to slide the lock pin 15 in the release direction as shown by A of FIG. 9A, it can delay a release operation. The lock pin 15 is slid in the release direction under applied high hydraulic pressure as shown by B of FIG. 9A, and releases from the engagement hole 19 to perform the releasing operation. In order to hold the released state, although the holding-release hydraulic pressure is equal to the biasing force of the biasing member 17, the holding-release hydraulic pressure may be smaller than the release hydraulic pressure as shown by C of FIG. 9A. Next about locking, they can be slid by only the biasing force of the biasing member 17 as shown by D of FIG. 9A. As described above, with the embodiment 5, it can have release hydraulic pressure characteristics with a hysteresis.

As described above, according to the embodiment 6, since the choke is formed in the release valve 21, it can create loss in release hydraulic pressure in advance to reduce difference in the flow rate of oil for release operation, and can delay a release operation. Thus, when hydraulic pressure rises on starting the engine, the lock pin 15 is not quickly released, and is released after applying hydraulic pressure which is able to control the valve timing control device. Therefore, it can prevent the occurrence of beat noise (abnormal noise).

According to the embodiment 6, a difference in the flow rate between release oil from the advance side hydraulic pressure chamber 10 and the retardation side hydraulic pressure chamber 11 is performed by the opening area difference there-between defined by the choke. Alternatively, the difference in the flow rate may be performed by length or bending difference of the oil paths.

Embodiment 7

Figure 11A:
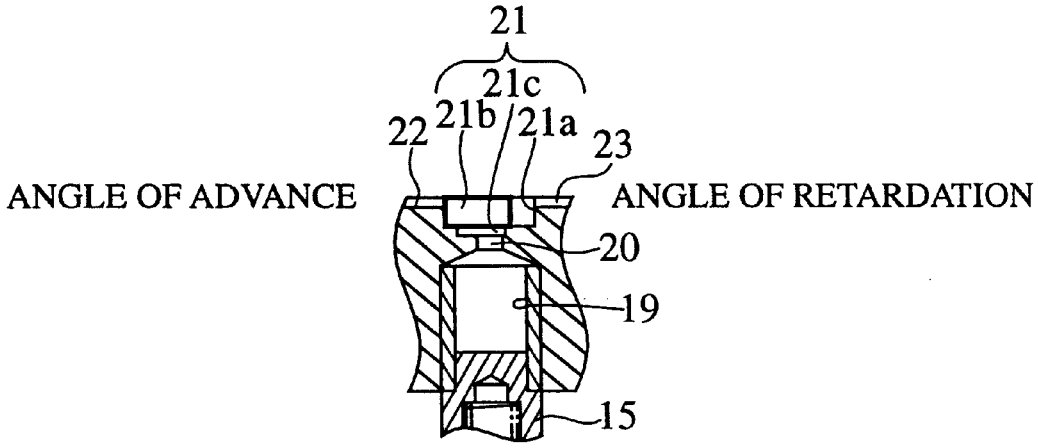
FIG. 11A, FIG. 11B, and FIG. 11C show an internal construction of a release valve in a valve timing control device as embodiment 7 according to the present invention.
Figure 11B:
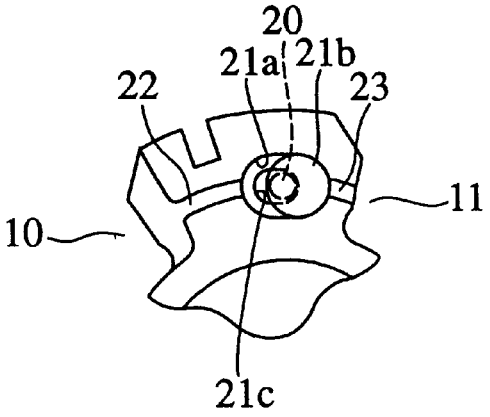
Figure 11C:
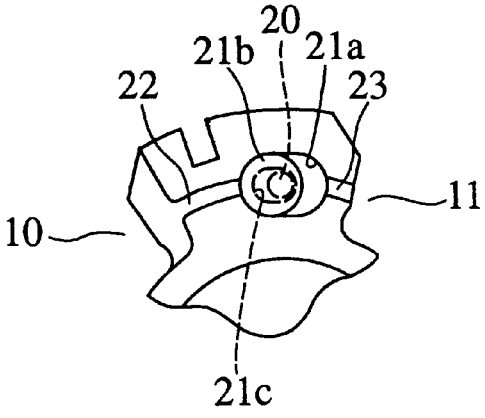

FIG. 11A, FIG. 11B, and FIG. 11C show an internal construction of a release valve in a valve timing control device as embodiment 7 according to the present invention. FIG. 11A is a longitudinal cross sectional view of the release valve. FIG. 11B is a lateral cross sectional view of the release valve on application of advance hydraulic pressure. FIG. 11C is a lateral cross sectional view of the release valve on application of retardation hydraulic pressure. Those components of the embodiment 7 of the present invention which are the same as those of the embodiment 1 are denoted by the same reference numerals and further description will be omitted. FIG. 9A and FIG. 9B also show hysteresis characteristics in a lock operation according to the embodiment 7 by reference here.

The embodiment 7 is characterized in that a choke of bringing loss of release hydraulic pressure in advance is arranged in the release valve 21, which is similar to the embodiment 6. Especially, the long radius of the perforation hole 21*c* in the release valve 21 is slightly shortened, and the perforation hole 21*c* shifts toward the advance side. In other words, when hydraulic pressure in the retardation side hydraulic pressure chamber 11 is higher, since the slide plate 21*b* shifted toward the advance side and the perforation hole 21*c* are overlapped. Thus, the retardation side hydraulic pressure chamber 11 communicates with the oil hydraulic supply path through a slight clearance defined between the slide plate 21*b* and the bottom of the valve chamber 21*a*. In this case. the amount of oil supplied to the oil hydraulic supply path depends on leakage of the clearance described above.

Next, a release operation will be explained.

When oil in the advance side hydraulic pressure chamber 10 is higher in a release operation, the slide plate 21*b* of the release valve 21 moves toward the retardation side to close the retardation side pressure partition path 23 as shown in FIG. 11B. Thus, the slide plate 21*b* communicates the advance side pressure partition path 22 with the advance side oil hydraulic supply path 20*a* through a widespread opening defined between the slide plate 21*b* and the perforation hole 21*c* to apply a release hydraulic pressure to the engagement hole 19. In this case, it does not result in loss of the release hydraulic pressure with respect to the first oil path 12. The lock pin 15 is different. from the embodiments 1 to 4, and is equal to the conventional construction. Thus, the release hydraulic pressure is equal to the holding-release hydraulic pressure as shown in FIG. 9B.

When oil in the retardation side hydraulic pressure chamber 11 is higher in a release operation, the slide plate 21*b* of the release valve 21 moves toward the advance side to close the advance side pressure partition path 22 as shown in FIG. 11C. Thus, the slide plate 21*b* communicates the retardation side pressure partition path 23 with the retardation side oil hydraulic supply path 20*b* through the minute opening between the slide plate 21*b* and the perforation hole 21*c* to apply release hydraulic pressure to the engagement hole 19. In this case, it results in loss of applied hydraulic pressure with respect to the second oil path 13. Since high release hydraulic pressure must be applied to slide the lock pin 15 in the release direction as shown by A of FIG. 9A, it can delay a release operation. The lock pin 15 is slid in the release direction under applied high hydraulic pressure as shown by B of FIG. 9A, and releases from the engagement hole 19 to perform the releasing operation. In order to hold the released state, although the holding-release hydraulic pressure is equal to the biasing force of the biasing member 17, the holding-release hydraulic pressure may be smaller than the release hydraulic pressure as shown by C of FIG. 9A. Next about locking, they can be slid by only the biasing force of the biasing member 17 as shown by D of FIG. 9A. As described above, with the embodiment 5, it can have release hydraulic pressure characteristics with hysteresis.

As described above, according to the embodiment 7, since the choke is formed in the release valve 21, it can reduce release hydraulic pressure in advance, and can delay a release operation. Thus, when hydraulic pressure rises on starting the engine, the lock pin 15 is not quickly released, and is released after applying hydraulic pressure which is able to control the valve timing control device. Therefore, it can prevent the occurrence of beat noise (abnormal noise).

According to the embodiment 7, a difference in the flow rate between release oil from the advance side hydraulic pressure chamber 10 and the retardation side hydraulic pressure chamber 11 is performed by the opening area difference there-between defined by the choke. Alternatively, the difference in the flow rate may be performed by length or bending difference of the oil paths.

With the embodiments 5 to 7, the area difference of opening in the oil path in the release valve 21 is utilized to reduce the amount of oil for release operation to delay the release operation. However, the area of opening, length or bending of the advance side pressure partition path and the retardation side pressure partition. path may be utilized to reduce the amount of oil for release operation to delay the release operation.

With the embodiments 5 to 7, when the rotor 9 as the second rotor is positioned at the most retardation side with respect to the first rotor, the lock pin 15 engages with the engagement hole 19 to restrict the free rotation between the first and second rotors. Alternatively, when the second rotor is positioned at the most advance side with the first rotor, the lock pin 15 may engage with the engagement hole 19. In this case, the amount of oil supplied from the advance side to the engagement hole 19 can be reduced to delay a release operation, such supply route being convenient as compared with a route supplied from the retardation side.

As described above, the present invention is explained in the embodiments 1 to 7 in detail. In order to perform the present invention, hysteresis characteristics must be set to obtain high release oil necessary to prevent the occurrence of beat noise on starting the engine. Further, the hysteresis characteristics must be set to obtain release hydraulic pressure and holding-release hydraulic pressure on closing of the purge valve mechanism, which is lower than the lowest hydraulic pressure generated after starting the engine.

With the present invention, embodiments as combinations of any one of the purge valve mechanism disclosed in the embodiments 2 to 4 and any one of the partition control mechanisms disclosed in the embodiments 5 to 7 have synergistic effects between function as for release operation to prevent the occurrence of beat noise with reliability.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a first rotor of rotating in synchronization with a crankshaft of an internal-combustion engine;

a second rotor fixed on an end of an intake camshaft or an exhaust camshaft of the internal-combustion engine and rotatably arranged in the first rotor;

a lock member of locking the first and second rotors at a required angle which the second rotor forms with the first rotor;

a backward pressure chamber arranged at any one of the first and second rotors, accommodating the lock member and a biasing member biasing the lock member, and having a discharge hole discharging backward pressure of the lock member; and an engagement hole arranged in the other of the first and second rotors, allowing insertion of the lock member, and having an oil hydraulic supply path supplying hydraulic pressure to release the lock member, wherein releasing hydraulic pressure characteristics is provided with hysteresis in that a releasing hydraulic pressure is larger than a holding-releasing hydraulic pressure.

2. A valve timing control device according to claim 1, further comprising a purge valve mechanism arranged within the lock member, and discharging the releasing hydraulic pressure to the out side, wherein the hysteresis is constituted by the purge valve mechanism.

3. A valve timing control device according to claim 2, wherein the purge valve mechanism is a slide valve mechanism.

4. A valve timing control device according to claim 2, wherein the purge valve mechanism is a check valve mechanism.

5. A valve timing control device according to claim 2, wherein the purge valve mechanism is a lead valve mechanism.

6. A valve timing control device according to claim 5, wherein the hysteresis is constituted by a difference in the flow rate between pressurized fluids which are set by elasticity of the purge valve mechanism or a support member of the purge valve mechanism.

7. A valve timing control device, comprising:

a first rotor of rotating in synchronization with a crankshaft of an internal-combustion engine;

a second rotor fixed on an end of an intake camshaft or an exhaust camshaft of the internal-combustion engine and rotatably arranged in the first rotor;

a lock member locking the first and second rotors at a required angle which the second rotor forms with the first rotor; a backward pressure chamber arranged at any one of the first and second rotors, accommodating the lock member and a biasing member biasing the lock member, and having a discharge hole of discharging backward pressure of the lock member;

an engagement hole arranged in the other of the first and second rotors, allowing insertion of the lock member, and having an oil hydraulic supply path of supplying hydraulic pressure to release the lock member; and a release valve having an advance side pressure partition path communicating an advance side hydraulic pressure chamber and a retardation side pressure partition path communicating a retardation side hydraulic pressure chamber to selectively supply the highest hydraulic pressure in the both chambers to the oil hydraulic supply path, wherein releasing hydraulic pressure characteristics are provided with hysteresis that releasing hydraulic pressure is larger than holding-releasing hydraulic pressure, the hysteresis is constituted by a difference in the flow rate between pressurized fluids from the advance side hydraulic pressure chamber and the retardation side hydraulic pressure chamber.

8. A valve timing control device according to claim 7, wherein the oil hydraulic supply path communicating the release valve is divided into an advance side oil hydraulic supply path and a retardation side oil hydraulic supply path, and wherein the difference in the flow rate between pressurized fluids is set by an opening area difference between the advance and retardation oil hydraulic supply paths.

9. A valve timing control device according to claim 7, wherein the difference in the flow rate between pressurized fluids is set by an opening area difference between an advance side pressure partition path and a retardation side pressure partition path, the respective paths communicating with the release valve.

10. A valve timing control device according to claim 7, wherein the difference in the flow rate between pressurized fluids is set by a length difference between an advance side pressure partition path and a retardation side pressure partition path, the respective paths communicating with the release valve.

11. A valve timing control device according to claim 7, wherein the difference in the flow rate between pressurized fluids is set by a bending difference between an advance side pressure partition path and a retardation side pressure partition path, the respective paths communicating with the release valve.

* * * * *